US005309067A

United States Patent [19]

Haskell

[11] Patent Number: 5,309,067

[45] Date of Patent: May 3, 1994

[54] CASCADE LIGHTING SYSTEM

[75] Inventor: Weston W. Haskell, Fulshear, Tex.

[73] Assignee: Vinalhaven, Inc., Fulshear, Tex.

[21] Appl. No.: 25,980

[22] Filed: Mar. 3, 1993

[51] Int. Cl.[5] ..... H05B 37/02

[52] U.S. Cl. ..... 315/360; 315/312; 315/314; 315/317; 315/321; 315/161; 315/164

[58] Field of Search ..... 315/360, 312, 314, 317, 315/321, 161, 164

[56] References Cited

U.S. PATENT DOCUMENTS 4,336,464 6/1982 Weber ..... 315/360
4,422,018 12/1983 Bailey ..... 315/360
4,924,109 5/1990 Weber ..... 315/360
5,150,012 9/1992 Pringle ..... 315/360

*Primary Examiner*—Robert J. Pascal
*Assistant Examiner*—Reginald A. Ratliff
*Attorney, Agent, or Firm*—Lee & Van Fleet

[57] ABSTRACT

An electronic switching circuit with driver which may be used to turn on an incandescent light after a predetermined delay and which circuit output may be utilized to trigger either itself or a like circuit connected in series. The electronic circuitry may optionally be contained within an electrical socket which provides both trigger input and output leads whereby the electrical sockets may then be connected in series to produce a cascade lighting system.

4 Claims, 5 Drawing Sheets

CASCADE LIGHTING SYSTEM

SUMMARY OF THE INVENTION a. Field of Invention

The present invention relates to cascade lighting systems and to cascade lighting systems wherein the circuitry necessary to create the sequential or cascade lighting effect is contained within the lamp sockets of the individual incandescent lamps which together form the cascade lighting system.

b. Background of the Invention

A substantial need exists for a cascade lighting system wherein each subsequent light in the series turns on following a predetermined delay following the turnon of the immediately prior light.

A further need exists for a cascade lighting system the length of which, the number of component lights, and the shape of the display can be arbitrarily chosen.

A yet further need exists for a cascade lighting system whereby the circuitry necessary to create the delayed light turnon timing is self-contained within the individual lamp sockets of the incandescent lamps which together form the cascade lighting system.

Accordingly, it is a primary object of this invention to provide a cascade lighting system wherein each subsequent light in the series turns on following a predetermined delay following the turnon of the immediately prior light.

It is a yet further object of this invention to provide a cascade lighting system the length of which, the number of component lights, and the shape of the display can be arbitrarily chosen.

It is a yet further and final object of this invention to provide for a cascade lighting system whereby the circuitry necessary to create the delayed light turnon timing is self-contained within the individual lamp sockets of the incandescent lamps which together form the cascade lighting system.

DESCRIPTION OF THE PREFERRED EMBODIMENT

Figure 1:
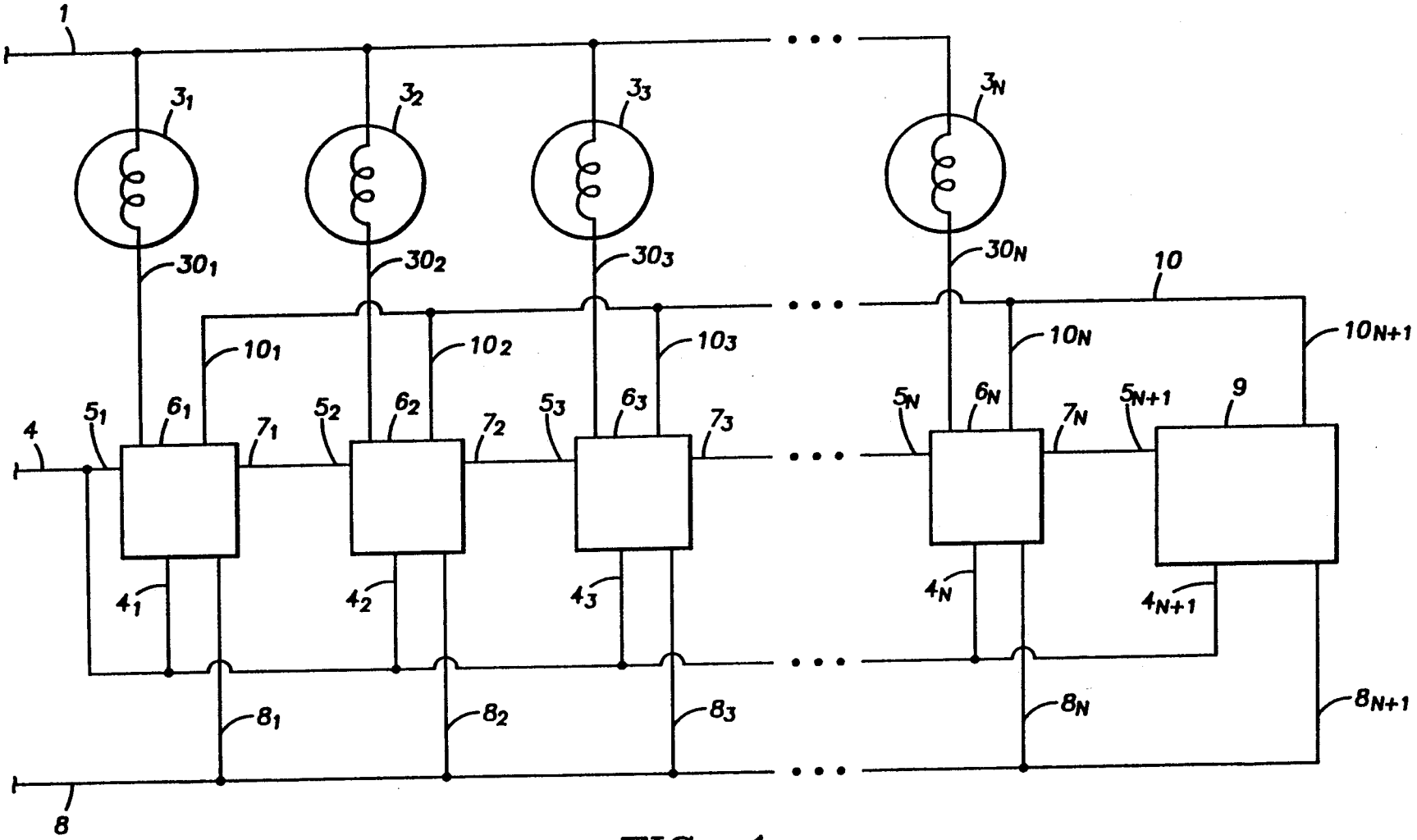
FIG. 1 is a a schematic block diagram showing the cascade connection of the circuits of the instant invention.

The electronic switching circuit of the instant invention, as is shown in FIG. 1, comprises an incandescent lamp (3), a timer/driver circuit (6), and a reset circuit (9), all fed by a +120 VDC line (1), a +12 VDC line (4), and a return or ground line (8). The timer/driver circuit (FIG. 2) comprises a commercially available LM2905 or comparable timing circuit (14), a MOSFET (2), which is a commercially available IRF722 or comparable device, a resistor (12), a resistor (13), and a capacitor (11). The reset circuit (FIG. 3) comprises a commercially available LM2905 or comparable timing circuit (14), a MOSFET (2), which is a commercially available IRF722 or comparable device, a resistor (12), a resistor (17), a resistor (18), a capacitor (11), a capacitor (19), and a capacitor (20).

FIG. 1 shows that innumerable timer/driver circuits ($6_{1-n}$) may be connected in cascade fashion with the trigger output (7) of each timer/driver circuit ($6_{1-n}$) connecting to the trigger input (5) of the next succeeding timer/driver circuit ($6_{2-n}$), provided that the cascade connection terminates in a reset circuit (9). This permits an indeterminate number of timer/driver circuits ($6_{1-n}$) to be connected in cascade whereby the visual effect of a "running light" may be achieved over practically any length string of incandescent lamps (3) desired.

Figure 2:
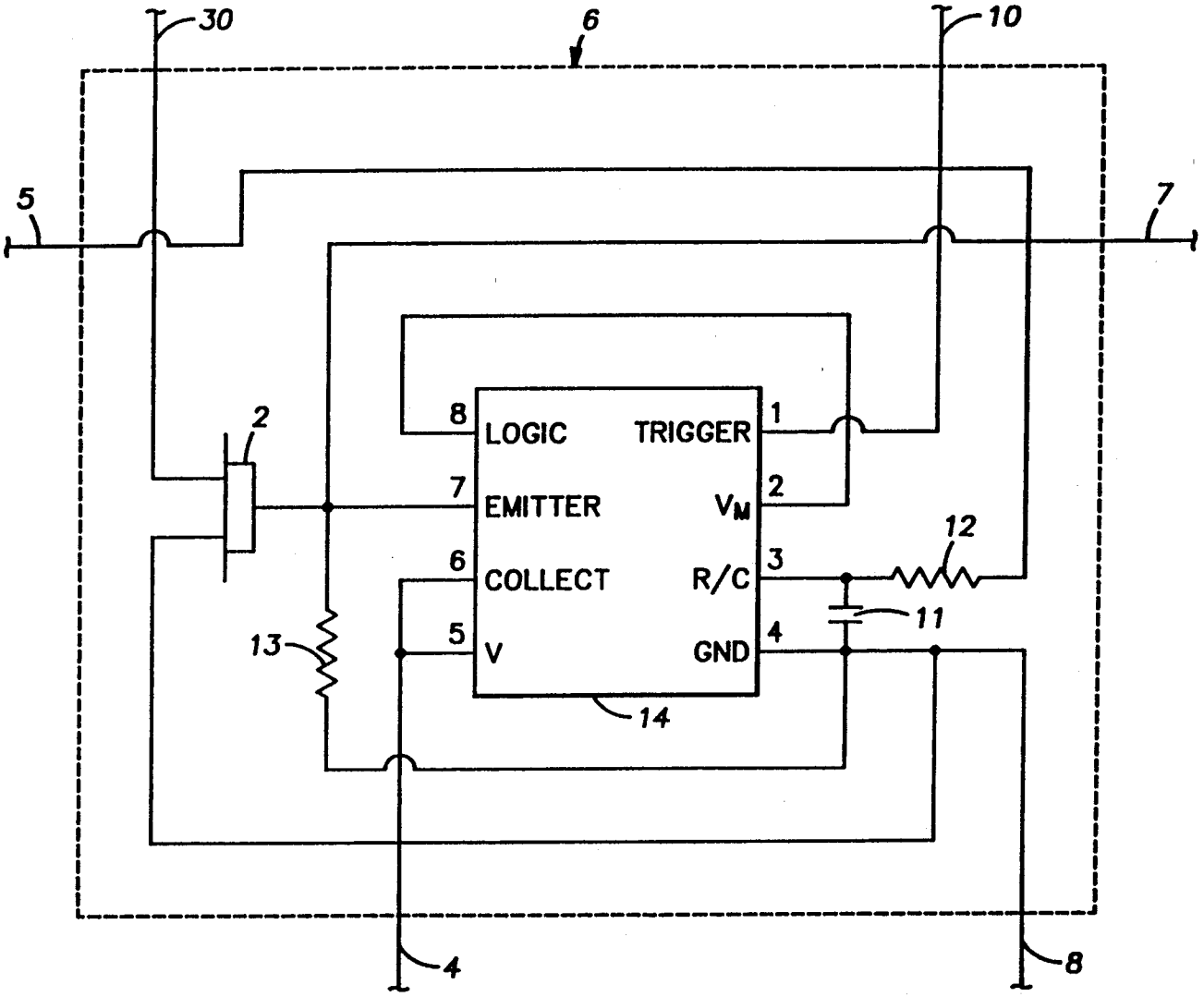
FIG. 2 is a schematic diagram of the electronic circuit of the instant invention.

Operation of the timer/driver circuit (6) is explained with reference to FIG. 2. The timer/driver circuit (6) requires two voltage sources for its operation. A +120 VDC line (1) is applied to one side of the incandescent lamp (3). The other side of the incandescent lamp (3) is connected to the anode of a MOSFET (2) which acts as a closed current switch whenever the gate voltage exceeds +2 VDC. The MOSFET (2) gate is connected to the output of pin 7 of the timing circuit (14). Pin 7 output of the timing circuit (14) is developed across the resistor (13) which is connected between pin 7 and the ground line (8). The pin 7 output of the timing circuit (14) is the trigger output (7) to the next circuit. A voltage of more than +2 VDC, on pin 3, of the timing circuit (14) causes a positive voltage to be applied to pin 7.

All of the pin assignments and connections discussed throughout this specification are specified for the particular timing circuit (14) utilized in the preferred embodiment. A +12 VDC line (4) is connected to pins 5 and 6 of the timing circuit (14). Pin 4 of the timing circuit (14) connects via a ground line (8) to the power supply return (8). Pins 8 and 2 of the timing circuit (14) are connected (shorted) together. Pin 1 is connected to the reset line (10). Pin 3 is connected to a capacitor (11) which in turn is connected on its opposite end to the ground line (8). Pin 3 is also connected to a resistor (12) whose other end is connected to the input trigger line (5). The charge time of the capacitor (11), determined by the RC time of the capacitor (11) and the resistor (12), determines the delay time before the timing circuit (14) will generate an output at pin 7. When the charge on capacitor (11) exceeds +2 VDC, the timing circuit (14) will trigger and generate a high output voltage approaching the +12 VDC supply voltage.

Operation of the timing circuit (14) within the first timer/driver circuit ($6_1$) is initiated by power turnon. The input trigger line (5) of the timing circuit (14) within the initial timer/driver circuit ($6_1$) is connected to the +12 VDC line (4) and an output (+12 VDC step voltage) will be generated at pin 7 immediately following the instant when the charge of the capacitor (11) exceeds +2 VDC.

Operation of each of the cascaded timer/driver circuits ($6_2$–$6_n$) will initiate in turn when the output trigger line (7) of the immediately preceding timing circuit (14) passes a positive output trigger voltage to the input trigger line (5) of timing circuit (14). Note that each output trigger line (7) is maintained in a high (about +12 VDC) state until such time as a reset pulse is received by the timing circuit (14) on the reset line (10) which is connected to pin 1. The reset pulse is a +2 VDC pulse of brief duration, determined by the RC times of the resistor (12) and the capacitor (11) chosen for the input trigger line (5) delay circuit. When a reset pulse is received at pin 1 of the timing circuit (14) via the reset pulse line (10), the timing circuit (14) drops its output at pin 7 to approximately ground potential, discharges the voltage at pin 3, and remains in a quiescent state awaiting another input trigger from the input trigger line (5).

Operation of the reset circuit (9) is explained with reference to FIG. 3. The reset circuit (9) requires but one power source for its operation. The following stated connections are made to the timing circuit (14) of the reset circuit (9). A +12 VDC line (4) is connected to pins 5 and 6. Pin 4 connects via a ground line (8) to the power supply return. Pins 8 and 4 are connected (shorted) together. This causes the output pin 7 to be high when pin 3 is low. Pin 3 is connected to a capacitor (11) which in turn is connected on its opposite end to the ground line (8). Pin 3 is also connected to a resistor (12) whose other end is connected to the input trigger line (5). The charge time of the capacitor (11), determined by the RC time of the capacitor (11) and the resistor (12), determines the delay time before the timing circuit (14) will cause the voltage to go to zero at pin 7. When the charge on capacitor (11) exceeds +2 VDC, the timing circuit (14) will change state and cause the voltage on pin 7 to go to zero.

Figure 3:
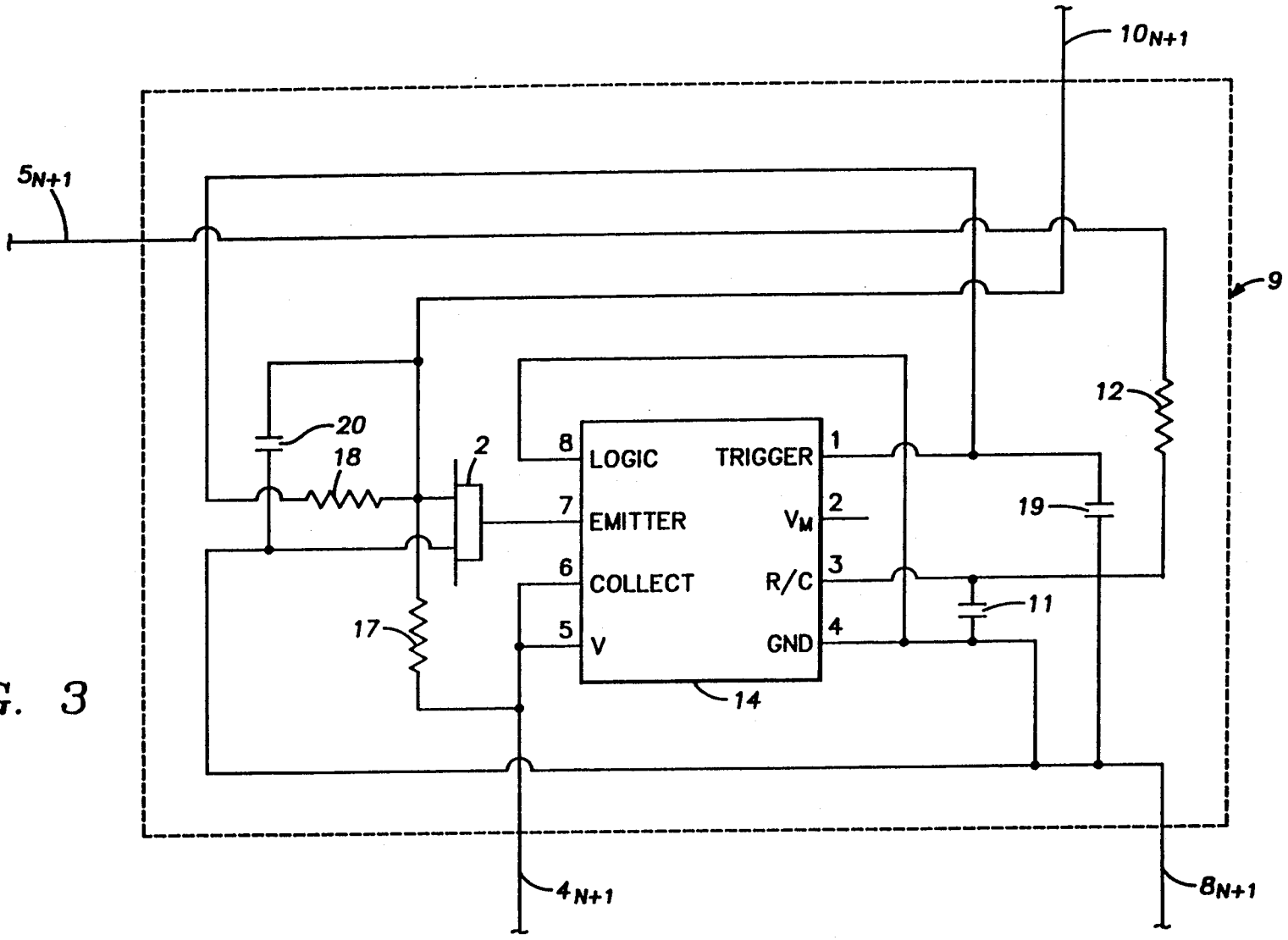
FIG. 3 is a schematic diagram of the reset circuit of the instant invention.

The reset circuit (9) timing circuit (14), as connected in FIG. 3, produces a normally high (about +12 VDC) output at pin 7 when pin 3 is at zero voltage of the timing circuit (14) because of the grounding, above-described, of pin 8. Pin 7 of the timing circuit (14) remains high so long as the voltage at pin 3 is less than one volt. Pin 7 of the timing circuit (14) is connected to the gate of the MOSFET (2) switch. Since the gate is held high, the MOSFET (2) is in a conducting state. The MOSFET (2) being in a conducting state holds the reset line (10) low because the MOSFET (2) draws current from the +12 VDC line (1) via the resistor (17) to the ground line (8). Thus, in the absence of a trigger on pin 3 of the timing circuit (14) the reset line (10) will be held low. The values required for the resistor (17) and the capacitor (20) were found by experimentation, such that the resistor (17) must be about 5000 ohms or less while the capacitor (20) must be greater then 0.1 microfarad. These values are required to prevent induced signals on the reset line (10) from causing spurious resetting of the whole string of incandescent lamps (3).

When a positive signal (greater than +2 VDC) is present on the input trigger line (5) of the reset circuit (9), then pin 7 of the timing circuit (14) goes low (near ground potential) and the MOSFET (2) ceases to conduct. This causes the reset line (10) potential to rise toward the voltage present on the +12 VDC line (4). The increasing potential on the reset line (10) then causes the capacitor (19) to begin to charge via the resistor (18). In the preferred embodiment the resistor (18) and the capacitor (19) are chosen to provide the same RC time as the RC time on the trigger input line (5), that is, the values are chosen to be the same as those of the resistor (12) and the capacitor (11). When the voltage on the capacitor (19) rises above +2 VDC then all the timing circuits (14) reset. At that point all timing circuits (14) are back to the initial state ready to repeat the cycle.

Figure 4:
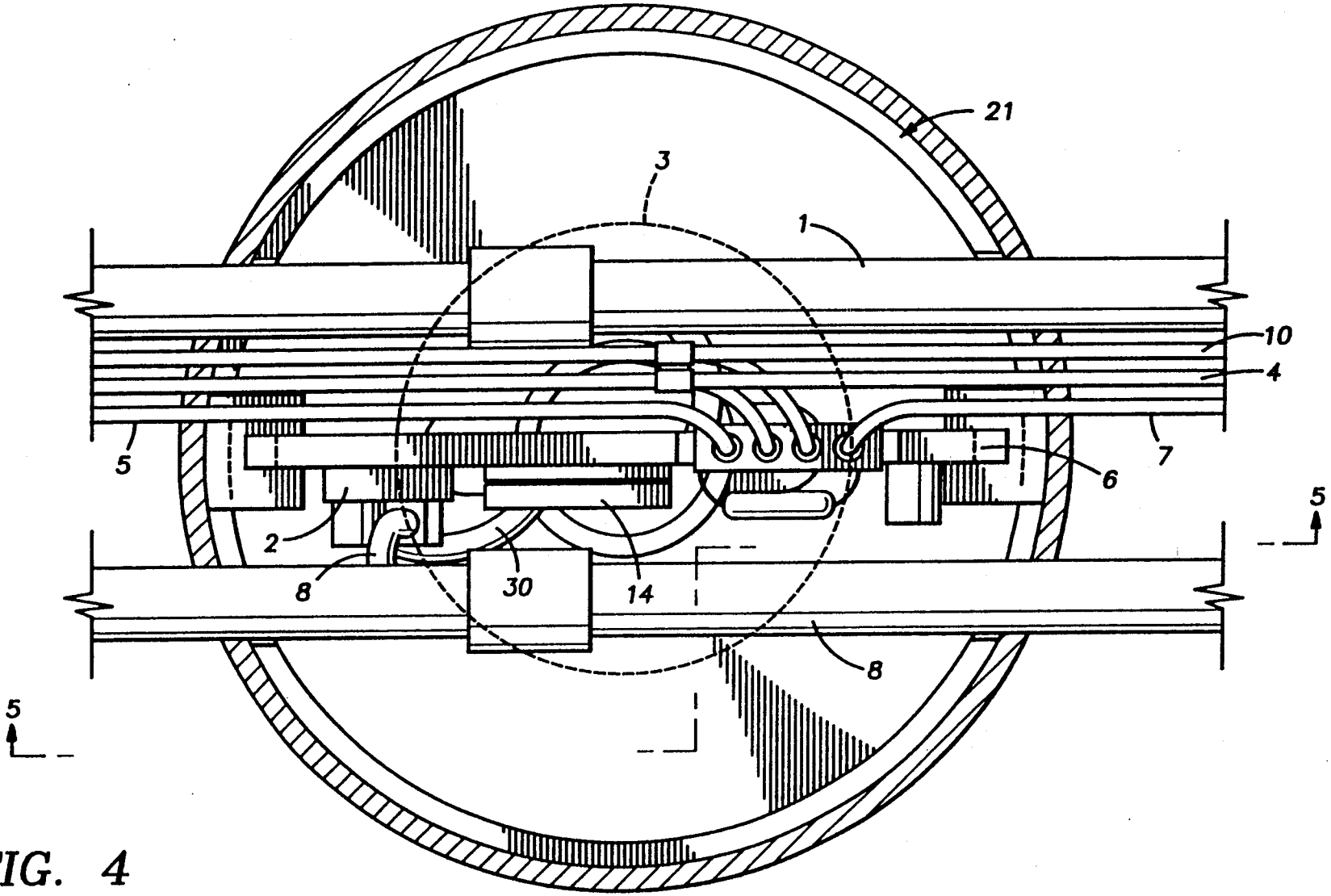
FIG. 4 is a vertical view of the electrical socket of the instant invention.
Figure 5:
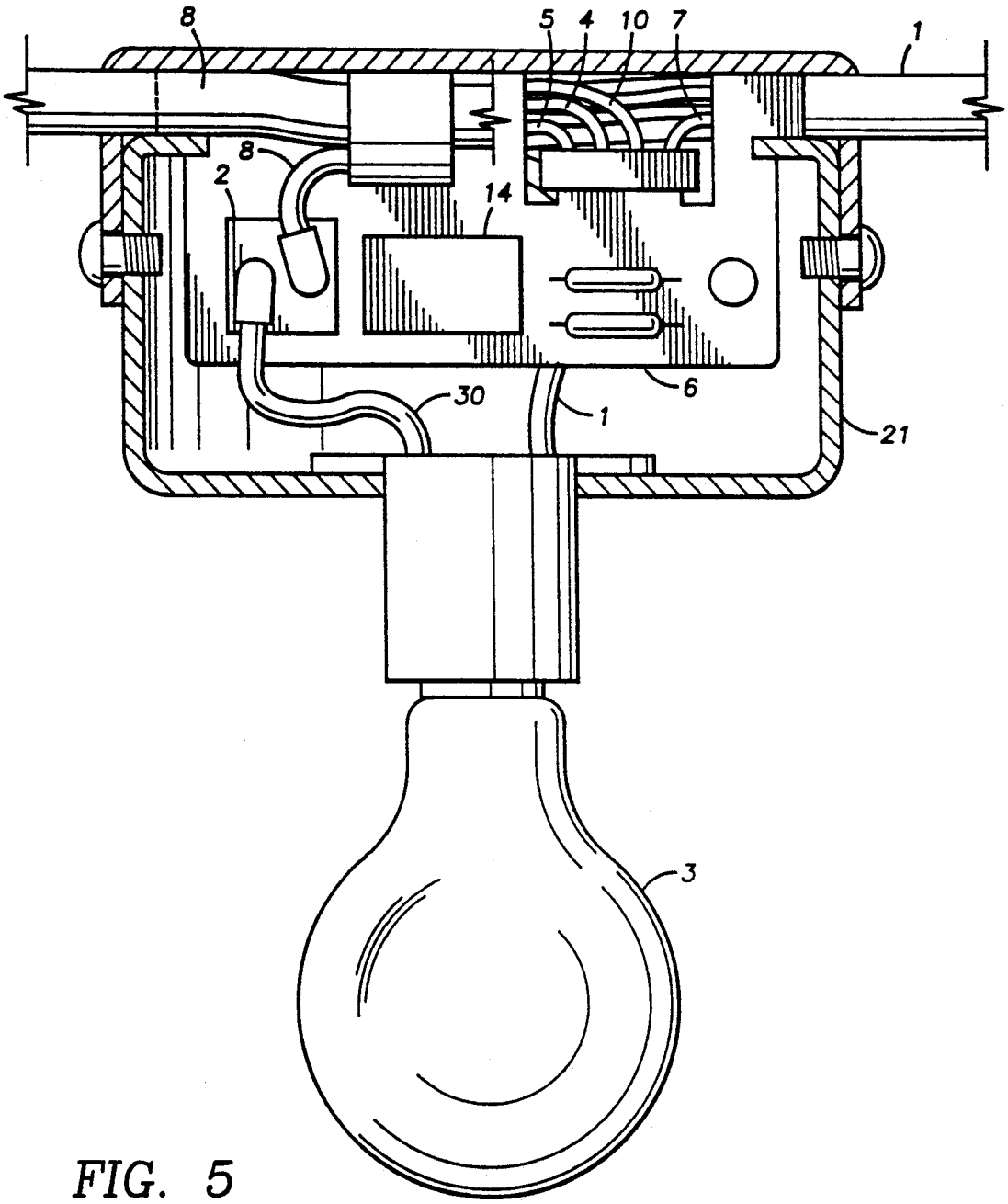
FIG. 5 is a cross-sectional view of the electrical socket of the instant invention taken along line A-A' of FIG. 4.

The above described timer/driver (6) and reset (9) circuits may be built into the bases of lamp socket housings (21) thus making a flexible device that could be utilized in making any kind of pattern. FIG. 4 shows a lamp socket housing (21) providing connections for the connection of a +12 VDC line (4), a trigger input line (5), a trigger output line (10), a +120 VDC line (1), and a power supply return line (8). As shown in FIG. 5, all components of either a timer/driver circuit (6) or a reset circuit (9) could be placed or constructed within the lamp socket housing (21) whereby interchangeable, perhaps multi-colored, incandescent lamps (3) could be screwably inserted into the lamp socket housings (21) of an indefinite length string of such lamp socket housings (21) and thereby create a cascade or "running" light effect in operation.

This invention has been described in terms of a single preferred embodiment, however numerous embodiments are possible without departing from the essential characteristics thereof. Accordingly, the description has been illustrative and not restrictive as the scope of the invention is defined by the appended claims, not by the description preceding them, and all changes and modifications that fall within the stated claims or form their functional equivalents are intended to be embraced by the claims.

I claim:

1. A cascade lighting system comprising two or more incandescent lamps, each of said incandescent lamps being electrically connected to:

an electrical power source;

a timer/driver circuit which comprises:

a semiconductor timing circuit which produces a high output when said timing circuit has received an input trigger, and said output stays high until said timing circuit has received a reset signal, at which time said timing circuit produces a low output until said timing circuit has received another input trigger, and a driver circuit, whose input is electrically connected to the output of said timing circuit, which acts as a closed switch electrically connecting said incandescent lamp with the power supply return when the input to said driver circuit semiconductor timing circuit is high; and a reset circuit which comprises:

a semiconductor timing circuit which produces a reset signal when said timing circuit has received an input trigger, and said output stays low until said timing circuit has received a reset signal, at which time said timing circuit produces a high output until said timing circuit has received another input trigger;

wherein three or more of said timer/driver circuits are electrically connected such that the output of each of said timer/driver circuits, save one, connects to the input of just one of the other of said timer/driver circuits, none of said timer/driver circuits has more than one input, the output of one of said timer/driver circuits connects to the input of said reset circuit, the output of said reset circuit connects to the reset input of all of said timer/driver circuits and of said reset circuit, and the input of just one of said timer/driver circuits is electrically connected to a constant high input signal.

2. The electronic switching circuit of claim 1 wherein the input to one or more of said timer/driver circuits provides an RC delay circuit and wherein the output of said reset circuit provides an RC delay circuit.

3. The electronic switching circuit of claim 1 wherein each of said timer/driver circuit is contained within an incandescent lamp socket housings.

4. The electronic switching circuit of claim 2 wherein each of said timer/driver circuit is contained within an incandescent lamp socket housings.

* * * * *